United States Patent [19]

Wessa

[11] 4,370,864

[45] Feb. 1, 1983

[54] METHOD AND APPARATUS FOR COOLING HEATED GASES OR LIQUIDS

[76] Inventor: Theo Wessa, Siedlung 19, 6751 Mackenbach, Pfalz, Fed. Rep. of Germany

[21] Appl. No.: 218,838

[22] Filed: Dec. 22, 1980

[30] Foreign Application Priority Data

Apr. 14, 1980 [DE] Fed. Rep. of Germany ..... 3014179

[51] Int. Cl.[3] ..... F25D 17/02

[52] U.S. Cl. ..... 62/98; 62/279; 62/390; 62/430

[58] Field of Search ..... 62/98, 389, 506, 279, 62/390, 430, 431, 64

[56] References Cited

U.S. PATENT DOCUMENTS

| | | | |
|---|---|---|---|
| 2,125,842 | 8/1938 | Eggleston | 62/238.6 |
| 2,221,530 | 11/1940 | Strang | 62/506 |
| 3,234,751 | 2/1966 | White | 62/506 |
| 3,913,343 | 10/1975 | Rowland et al. | 62/137 |
| 4,293,323 | 10/1981 | Cohen | 62/238.6 |

FOREIGN PATENT DOCUMENTS

| | | | |
|---|---|---|---|
| 565462 | 11/1932 | Fed. Rep. of Germany | 62/115 |
| 55-49639 | 10/1980 | Japan | 62/279 |

*Primary Examiner*—Ronald C. Capossela

*Attorney, Agent, or Firm*—Orville N. Greene

[57] ABSTRACT

A method and apparatus for cooling a fluid coolant is disclosed. Cooling water, not under pressure, is circulated in a container. The coolant is passed under pressure through cooling pipes immersed in the cooling water.

13 Claims, 1 Drawing Figure

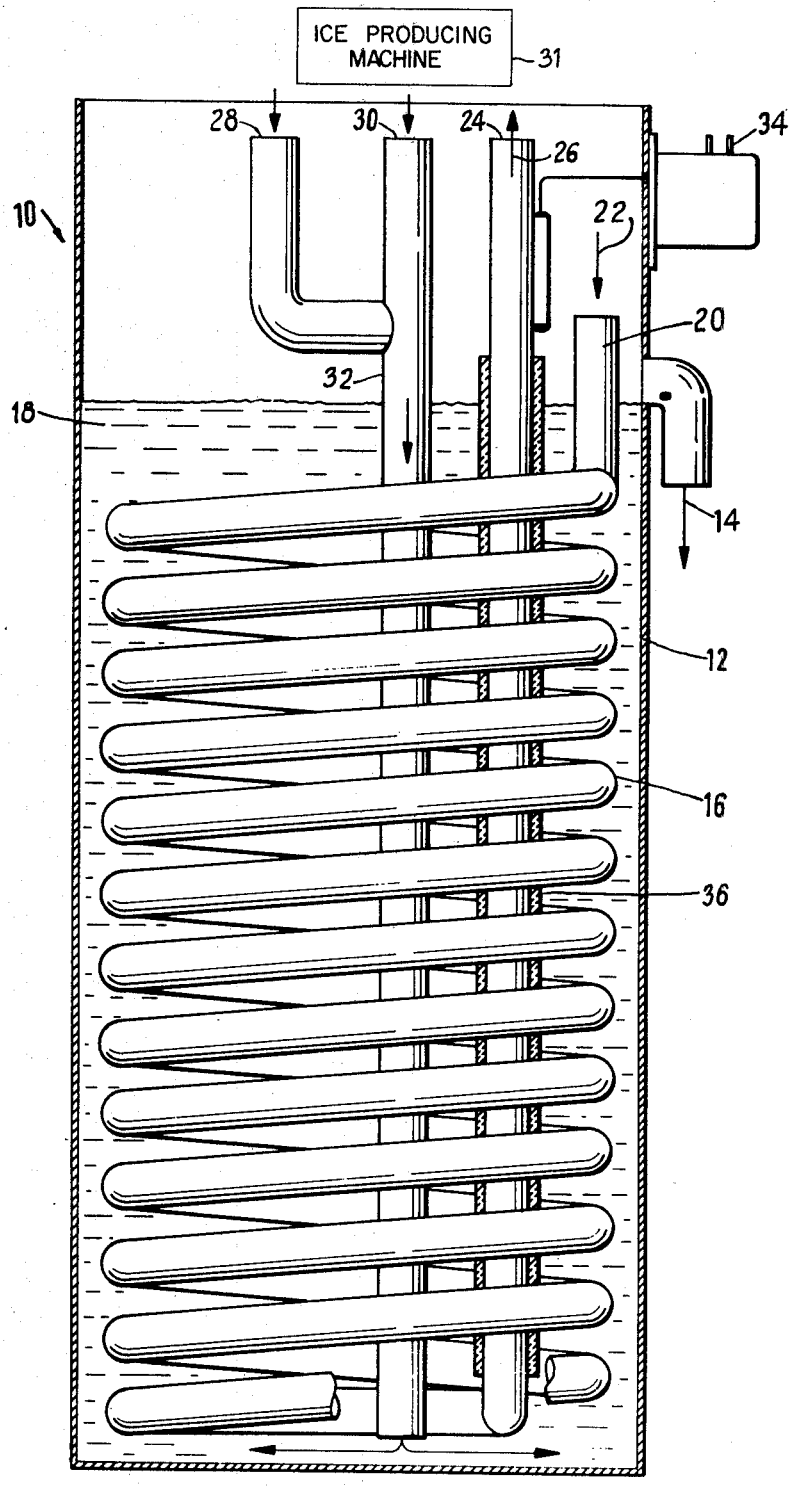
ICE PRODUCING MACHINE
31
28
30
24
26
34
10
22
20
32
18
14
12
16
36

METHOD AND APPARATUS FOR COOLING HEATED GASES OR LIQUIDS

BACKGROUND OF THE INVENTION

The present invention relates to a method of cooling heated gases or liquids and to an apparatus for the carrying out of this method. Such method and apparatus may be used, for example, in connection with the cooling of refrigerants for automatic ice-cube machines.

Known cooling devices, developed as water-cooled condensers, consist of a water-conducting center pipe over which an outer pipe is placed. The fluid to be cooled, for instance a refrigerant under pressure, flows in the annular space defined between the inner and outer pipes. The amount of water flowing (under pressure) through the center pipe is regulated by a flow regulator which is connected to the refrigerant circuit. In this way, the rate of flow of the water required for cooling the heated coolant is determined. The water-conducting pipe coils are, therefore, under pressure and are thus exposed to continuous loads which may lead to leaks and hairline cracks and thus to the destruction of the system. Furthermore, depending on the hardness of the water, deposits of lime may be formed in the relatively small pipe cross sections, which may reduce the cooling effect or even cut off the cooling effect completely.

For the operation of these condensers, an antifreezing system is required if the condensers are subjected to freezing conditions. If such a system is not provided, the water-conducting pipes may burst and the emerging water destroy the cooling system. Furthermore, there is always the danger of leaks at the solder points of the pipe connections. Control over the water flow by the flow regulator is slow as compared with the rapidly flowing cooling water so that cooling water continues to flow and discharge without its cooling energy being fully utilized.

BRIEF DESCRIPTION OF THE INVENTION

The primary object of the present invention is to avoid the aforementioned drawbacks and to develop a simple condenser which is more economical in energy and water consumption as well as more dependable in operation than the known cooling devices.

The present invention achieves this purpose, starting from the process described above, by passing the heated coolant through a container housing cooling water which is not under pressure. This results, on the one hand, in a substantial simplification of the method and a corresponding structural simplification of the apparatus necessary for the carrying out of the method.

As a further feature of the method of the invention, residual water from the system in which the refrigerant is used may be introduced into the cooling water container, in addition to cold fresh water. Such residual water may, for example, be a by-product of the production of ice in automatic ice cube machines. This results in a significant energy saving.

In the apparatus for the carrying out of the method, the condenser consists of a cooling-water container in which the cooling water is fed into the container near the bottom thereof and the overflow water is removed from a location above the pipes of the cooling coil. Accordingly, relatively cool water is added to the bottom of the container and cools the heated coolant (contained in cooling coils located in the water) by a heat exchange process. As the water rises to the top of the container, it picks up heat from the cooling coils and is discharged as relatively warm water at a location above the cooling coils.

The ascending pipe of the cooling coil is preferably heat-insulated.

A major advantage of the present invention resides in the fact that it is possible to achieve high dependability in operation using simple structures and that water resulting from thawing, drip water and cold residual water from automatic ice cube machines or the like, can be used as part of the condensing system. This saving in energy results, on the one hand, from the saving of water itself and, on the other hand, from the substantially better utilization of the cooling energy. The time that the water remains in the condenser is increased with the result that the water transfers its cooling energy more intensively. The temperature gradient between cooling water and the fluid to be cooled is greater in the lower portions of the pipe coil than in the upper portions thereof. Only the cooling water which has been fully utilized and which has heated up (i.e., the water located near the top of the container) is discharged at a location above the cooling coil. Due to the long period of time that the water remains in the container, the frequency at which fresh water need be switched or regulated is also reduced.

A substantial saving in energy is obtained when, for instance, highly cooled residual water from the preparation of ice in automatic ice-cube machines, which is otherwise discharged unused, is employed as supplemental cooling water or even used as the entire cooling water. In the pressure-less condenser of the invention, the feeding of this water is possible at any time in addition to the normal tap water from the water supply system, or instead thereof. Calculations have shown that a refrigerator of an automatic ice-cube machine of ¼ HP (=0.18 KW) and a daily output of about 50 kg, when using the strongly cooled residual water from the preparation of the ice during each ice production period, requires about 3 liters/hour of cooling water for the condensation of the heated refrigerant in the method of the invention. Known systems, on the other hand, require about 20 liters of cooling water per hour.

BRIEF DESCRIPTION OF THE DRAWING

For the purpose of illustrating the invention, there is shown in the drawing an embodiment which is presently preferred, it being understood, however, that the invention is not limited to the precise arrangements and instrumentalities shown.

The drawing shows a diagrammatic view of a condenser in accordance with the invention.

DETAILED DESCRIPTION OF THE PREFERRED EMBODIMENT

Referring now to the drawing, there is shown a condenser constructed in accordance with the principles of the present invention and designated generally as 10. Condenser 10 includes an outer container 12 which is provided with an outlet 14 which is arranged above a pipe cooling coil 16 located in the container 12. Cooling water 18 is located in the container 12 and rises in the container during the heat transfer process due to the fact that new water is added to the bottom of container 12. As a result, the warmed water discharges through the outlet 14 located above the pipe coil 16.

The heated coolant 20 flows down through the cooling coil 16 in the direction indicated by the arrow 22, cools down in the lower region of coil 16 and thereby passes from its gaseous state into a liquid state. The liquid coolant 20 now flows upward through the heat insulated riser 24, leaves the condenser in the direction indicated by the arrow 26 and is fed as refrigerant, for instance for the preparation of ice, to an evaporator. Riser 24 is insulated by a heat insulating jacket 36.

Fresh water is fed into container 12 via an input pipe 28, and any cold residual water, for instance residual water produced during each ice-production period in an ice-producing machine 31 (such water being cooled to 0° C.), is fed into container 12 via pipe 30. The water entering pipes 28, 30 then passes to the bottom of container 12 through down pipe 32 and is discharged near the bottom of container 12. The container 12 and cooling coil 16 therefore operate as countercurrent condenser, the refrigerant following in downward direction and the cooling water in upward direction.

If it is preferable to utilize primarily cold residual water for cooling purposes, then a valve (not shown) can be used to control the flow of fresh water via pipe 28. In such a case, the operation of the valve could be controlled by a thermostat 34 which monitors the temperature of the coolant in pipe 24.

The present invention may be embodied in other specific forms without departing from the spirit or essential attributes thereof and, accordingly, reference should be made to the appended claims, rather than to the foregoing specification as indicating the scope of the invention.

What is claimed is:

1. A method for cooling a fluid coolant, comprising the steps of:

providing an open topped container;

supplying cooling water to said container at a location near the bottom thereof and permitting said cooling water to be removed from said container by overflowing through an overflow outlet located near said open top of said container;

circulating coolant under pressure through a coolant pipe located in said container and extending substantially from the bottom of said container to said overflow output, said coolant flowing through said cooling pipe in such a manner that it first comes into thermal contact with said cooling water near the top of said container and thereafter continues down said cooling pipe toward the bottom of said container, whereby said coolant comes into thermal contact with increasingly cooler water as it moves down said pipe.

2. A method according to claim 1, wherein said coolant is used in connection with a cooling apparatus which produces residual water and wherein said residual water is circulated through said container as part of said cooling water.

3. A method according to claim 2, wherein said cooling apparatus is an ice-cube machine and said residual water is ice water.

4. A method according to any one of claim 1, wherein said cooling water leaves said container via an overflow spout located near the top thereof.

5. An apparatus for cooling a fluid coolant, said apparatus comprising:

an open topped container;

means for supplying cooling water to said container at a location near the bottom thereof;

an overflow outlet located near the open top of said container for permitting overflow water to exit from said container;

a cooling pipe located in said container and extending substantially from the bottom of said container to said overflow outlet; and means for circulating coolant under pressure through said cooling pipe, said circulating means causing said coolant to flow through said cooling pipe in such a manner that it first comes into thermal contact with said cooling water near the top of said container and thereafter continues down said cooling pipe toward the bottom of said container, whereby said coolant comes into thermal contact with increasingly cooler water as it moves down said pipe.

6. An apparatus according to claim 5, wherein said water is circulated through said container by gravity.

7. An apparatus according to claim 5, wherein said cooling pipe takes the form of a spiral.

8. The combination comprising:

(A) a cooling machine which produces residual water, said cooling machine utilizing a fluid coolant;

(B) apparatus for cooling said fluid coolant, said apparatus comprising:

(1) an open topped container;

(2) means for supplying cooling water to said container at a location near the bottom thereof;

(3) an overflow outlet located near the open top of said container for permitting overflow water to exit from said container;

(4) a cooling pipe located in said container and extending substantially from the bottom of said container to said overflow outlet;

(5) means for circulating said coolant under pressure through said cooling pipe, said circulating means causing said coolant to flow through said cooling pipe in such a manner that it first comes into thermal contact with said cooling water near the top of said container and thereafter continues down said cooling pipe toward the bottom of said container whereby said coolant comes into thermal contact with increasingly cooler water as it moves down said pipe;

(C) means for introducing said residual water into said container as a part of said cooling water.

9. The combination according to claim 8, wherein said cooling machine is an ice cube machine and said residual water is ice water.

10. The combination of claim 8 or 9, wherein said cooling pipe includes a riser pipe extending from a location near the bottom of said container to a location near the top of said container and wherein said riser pipe is covered by a heat insulating jacket.

11. The combination of claims 8 or 9, wherein said water is circulated through said container by gravity.

12. An apparatus according to claim 11, wherein said cooling pipe takes the form of a spiral.

13. The combination of claims 8 or 9, wherein said cooling pipe takes the form of a spiral.

* * * * *